US005131350A

United States Patent [19]

Buschor

[11] Patent Number: 5,131,350

[45] Date of Patent: Jul. 21, 1992

[54] ELECTROSTATIC POWDER COATING DEVICE

[75] Inventor: Karl Buschor, St. Gallen, Switzerland

[73] Assignee: Ransburg-Gema AG, St. Gallen, Switzerland

[21] Appl. No.: 565,575

[22] Filed: Aug. 10, 1990

[30] Foreign Application Priority Data

Aug. 11, 1989 [DE] Fed. Rep. of Germany ..... 3926624

[51] Int. Cl.[5] ..... B05C 19/06

[52] U.S. Cl. ..... 118/308; 118/629; 118/692; 118/713; 137/552

[58] Field of Search ..... 118/692, 713, 629, 302, 118/308; 137/551, 552

[56] References Cited

U.S. PATENT DOCUMENTS

| | | | |
|---|---|---|---|
| 3,504,945 | 4/1970 | Leibundgut et al. | 406/144 |
| 3,521,815 | 7/1970 | Szasz | 239/513 |
| 3,586,045 | 6/1971 | Zimmer | 137/551 |
| 3,665,959 | 5/1972 | Castillon | 137/551 |
| 3,768,510 | 10/1973 | Reves | 137/552 |
| 3,974,856 | 8/1976 | Lancier | 137/552 |
| 4,017,029 | 4/1977 | Walberg | 118/629 |
| 4,077,354 | 3/1978 | Walberg | 118/629 |
| 4,500,560 | 2/1985 | Guffroy | 118/629 |
| 4,720,801 | 1/1988 | Boll | 364/510 |
| 4,788,933 | 12/1988 | Buschor | 118/629 |
| 4,802,625 | 2/1989 | Buschor | 239/3 |

FOREIGN PATENT DOCUMENTS

| | | |
|---|---|---|
| 0297309A3 | 1/1989 | European Pat. Off. . |
| 1266685 | 4/1968 | Fed. Rep. of Germany . |
| 1652384 | 8/1971 | Fed. Rep. of Germany . |
| 2217865 | 11/1972 | Fed. Rep. of Germany . |
| 2264386 | 5/1973 | Fed. Rep. of Germany . |
| 3323636 | 1/1985 | Fed. Rep. of Germany . |
| 3629028 | 3/1988 | Fed. Rep. of Germany . |
| 505653 | 5/1971 | Switzerland . |
| 609586 | 3/1979 | Switzerland . |

OTHER PUBLICATIONS

Perry, John H., *Chemical Engineers' Handbook*, 4th ed., McGraw-Hill Book Co., New York, N.Y., 1963, pp. 5-13.

*Primary Examiner*—Richard L. Chiesa
*Attorney, Agent, or Firm*—Barnes & Thornburg

[57] ABSTRACT

Contained in the feed gas line (4) and in the dosing gas line (24) of an injector (2) is a pressure setting instrument (6, 26) each which is adjustable with regard to its outlet pressure. A gas flow instrument (46) displays the entire amount of feed air and dosing air flowing per unit of time. This makes it possible to change the pressures of the feed air and the dosing air while nonetheless keeping the entire gas quantity in the powder/gas flow in a simple way at a desired value.

10 Claims, 1 Drawing Sheet

ELECTROSTATIC POWDER COATING DEVICE

The invention concerns an electrostatic powder coating device.

Such an electrostatic powder coating device is known from practice. Provided on it are pressure controls as pressure setting devices. Instead of pressure controls, however, also adjustable cocks or adjustable flow throttles could be used. Injectors for the pneumatic feeding of coating powder are known from the German patent document 1,266,685 (U.S. Pat. No. 3,504,945). Spray devices may have the form of manually actuated guns or automatically controlled spray apparatuses. Depending on the desired spray process, the spray device may vary in its design, as can be seen, e.g., from the Swiss patent document 429,517 (=U.S. Pat. No. 3,521,815), German patent document 36 08 415 (=U.S. Pat. No. 4,802,625) and the German patent document 36 08 426 (U.S. Pat. No. 4,788,933). Illustrated in the latter two documents are spray devices to which, in addition to the powder/gas flow, there is a scavenging gas supplied which flows across electrodes for the electrostatic charging of the coating powder, thereby cleaning these electrodes and keeping them free of contaminations through powder depositions. The high voltage for the electrodes can be generated in customary fashion by a voltage generator contained in the spray device or by an external voltage generator. The voltage of the voltage generator creates between the electrodes and an object to be coated, which is grounded, an electrostatic field along which the particles of the coating powder proceed from the spray device to the object.

To achieve a constant flow of powder/air mixture, the air velocity in the fluid lines, specifically in the powder feed hoses, must range between 10 and 15 m/sec. A lower air velocity in the fluid line renders the powder feeding disuniform; a pulsation of the powder-/air mixture occurs which propagates up to the powder discharge from the spray device. A higher air velocity greatly affects the electrostatic application of the coating powder on the object being coated, risking that the powder which has already been deposited on the object will be blown off again.

Depending on the requirements of the coating operation, the powder quantity supplied to the spray device is increased or reduced. An experience value for the powder quantity supplied per unit of time is 300 g/min. When it is necessary to reduce the amount of powder supplied per unit of time, the pressure of the feed air supplied to the injector is reduced first. This reduces also the flow velocity of the feed air in the fluid lines. However, the overall air amount must neither be too low nor exceed a maximum. To balance this air rate reduction, i.e., to arrive again at at least 10 mm/sec air velocity while retaining a reduced powder ejection, more dosing air is fed to the injector. The known function of the injectors is as follows:

The feed air generates in the injector a vacuum which causes coating powder to be sucked from a powder container, to be entrained by the feed air and fed through fluid lines to the spray device. By variation of the pressure and thus also the amount of feed air, the amount of coating powder fed per unit of time can be adjusted. The feed capacity depending on the magnitude of the vacuum generated by the feed air in the injector, the feed capacity can at constant or variable feed air also be controlled by introducing dosing air in the vacuum area of the injector, in order to thereby vary the magnitude of the vacuum in accordance with the desired feed quantity of powder. This means that the quantity of powder fed is not contingent solely on the amount of feed air, but on the difference of feed minus dosing air. The overall air quantity that carries the coating powder, however, must for the initially cited reasons remain constant for a specific coating operation.

In practice, the operator observes the cloud of coating powder directed at the object being coated and adjusts on the basis of this visual observation the pressures of the feeding air and of the dosing air. In order for the adjustments to be made properly, diagrams are prepared by the manufacturer of the coating equipment and supplied along with it. Thus, the operator is able to adjust the pressure setting device for the feeding air and the pressure setting device for the dosing air in such a way that their pres sure values will be within a range shown on the diagrams. However, the diagrams are observed by the operator only seldom or never, with the effect that the operation often proceeds with incorrect settings.

The problem to be solved by the invention is to facilitate the correct setting of the feeding air quantity and dosing air quantity to optimum values.

According to the invention, a first flow measuring instrument is used which provides a display which is contingent on the entire quantity of gas flowing per unit of time and which serves to transport the coating powder from the injector to the spray device. This first flow measuring instrument is preferably arranged in the gas supply line which supplies the feed gas and the dosing gas. This gas flow measuring instrument is preferably a so-called suspended body flow meter. In it, a floating body hovers in an upward gas flow. The height level of the floating body depends on the strength of the gas flow and, therefore, is a measure for the quantity of gas passing per unit of time through the floating body flow meter. The flow meter may be provided with markings which are adapted to the amount of gas flow. Thus, in changing the feed gas pressure and/or the dosing gas pressure, the operator can observe on the floating body flow meter that the floating body will be contained and/or within specific markings that correspond to the optimum overall gas quantity of feed gas and dosing gas which together with the coating powder flows from the injector to the spray device. As initially mentioned, the optimum amount of the overall gas depends on several factors, in which context here the diameter and length of the fluid lines are additionally mentioned yet.

Another application of the inventional idea consists in using a second flow measuring instrument in a supplemental gas line, through which supplemental gas can be fed to the spray device, separate from the coating powder flow. The supplemental gas may serve the cleaning of parts of the spray device, for instance the cleaning of electrodes, such as shown in the German patent documents 36 08 426 and 36 08 415, or may serve the generation of a gas wall situated in the flow path of the coating powder flow, such as shown in the said German patent document 36 08 426, or may serve the generation of gas flows which prevent a deposition of coating powder on specific outside surfaces of the spray device, such as known from the German patent disclosure 25 09 851. The pressure of the supplemental gas is set with a third pressure setting instrument in contingence on inside diameter sizes and in contingence on the length of the fluid lines as well as in contingence on other coating criteria.

The inside diameter sizes and lengths as well as other criteria may vary depending on the use of the powder coating device, requiring then that the pressure of the supplemental gas be changed. At the same time though it is frequently necessary to keep the amount of supplemental gas fed per unit of time constant at a predetermined optimum value. The use of a second flow measuring instrument enables the operator to recognize variations of the supplemental gas quantities and to effect pressure settings on the third pressure setting instrument in such a way that the optimum supplemental gas quantity will be retained. Also the supplemental gas is preferably air.

In addition to the advantage of a facilitated setting of optimum values, the invention also offers the advantage that the values are reproducible in a simple way. Reproducible means here that upon adjustment of the feeding air and/or dosing air and/or supplemental air the original conditions and the overall air quantity can later be adjusted again.

BRIEF DESCRIPTION OF THE DRAWING

The invention will be described hereafter with reference to the drawing.

DESCRIPTION OF THE PREFERRED EMBODIMENT

Figure 1:
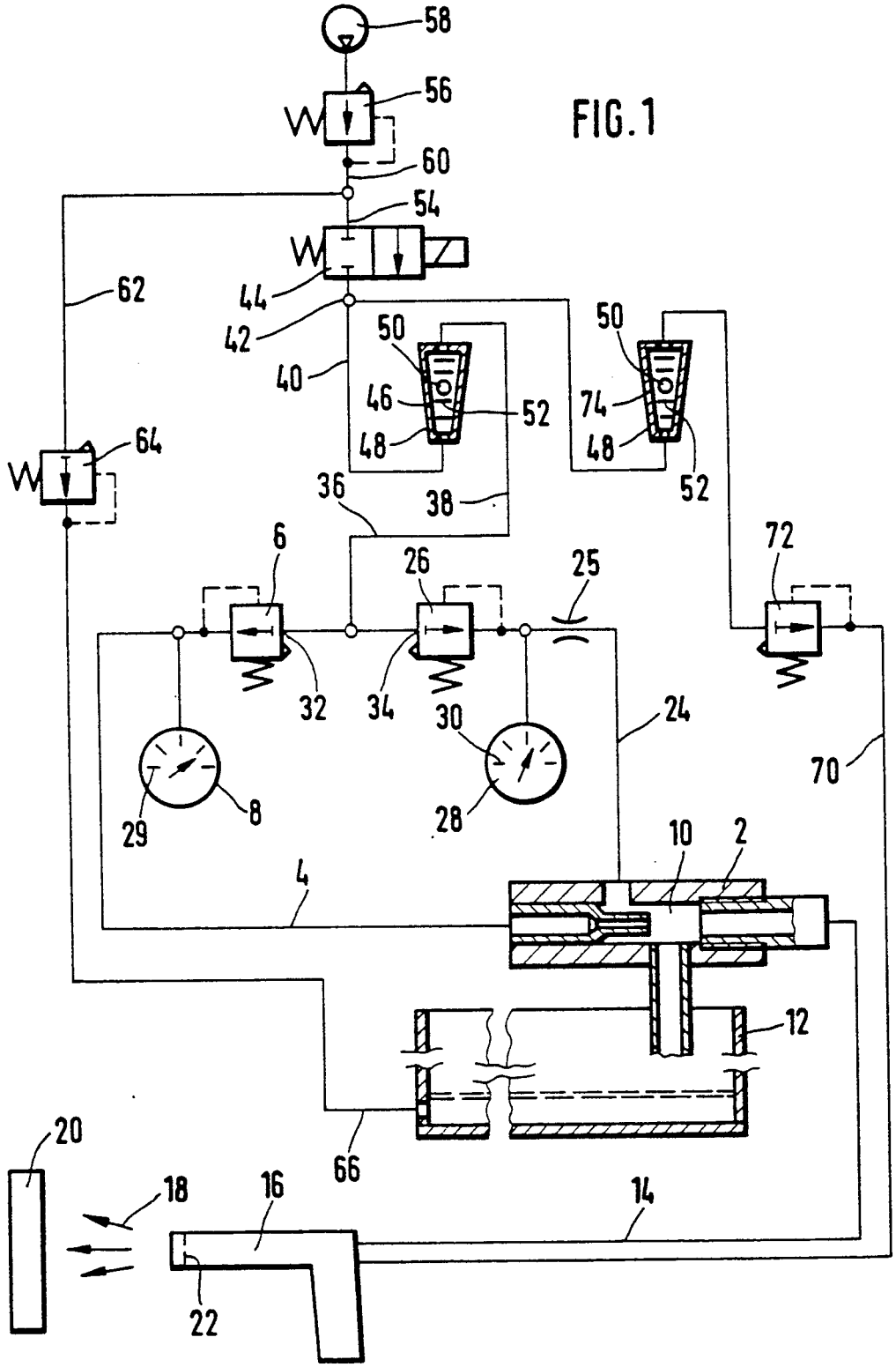
FIG. 1, not at scale and schematically, shows a preferred embodiment of an electrostatic powder coating device according to the invention.

The electrostatic powder coating device according to the invention comprises an injector 2 which operates according to the principle of the Venturi nozzle, also known as water jet pump. Connected to the injector 2 is a feed gas line 4 in which there is installed a first pressure setting instrument 6 in the form of an adjustable pressure regulator for setting the pressure of the feed air, and a feed gas pressure gauge 8 which optically displays the pressure of the feed air. The feed air generates in the vacuum area 10 of the injector 2 in known fashion a vacuum, thereby sucking from a powder container 12 coating powder which then is fed by the feed air through a powder feed line 14, normally a hose, to a spray device 16. The spray device comprises in known fashion electrodes for the electrostatic charging of the coating powder and atomizes the coating powder 18 in the form of a powder cloud toward an object 20 being coated. The electrodes 22 in the spray device 16 are illustrated only schematically. The spray device 16 may have the form of a manually operated gun or of an automatic spray device.

Additionally connected to the injector 2 is a dosing gas line 24 in which there are installed a flow throttle 25 and, upstream from it, a second pressure setting instrument 26 in the form of an adjustable pressure governor or regulator and a second pressure gauge 28 for adjustment and visual display of the dosing gas pressure. The gauges 8 and 28 thus need to be arranged downstream from the pressure setting instrument and adjustable pressure governor or regulator 6 and 26 respectively. The dosing air can flow from the dosing gas line 24 into the vacuum area 10 of the injector 2. The injector 2 feeds the most coating powder when no dosing air is supplied. The greater the dosing air supply the lower is the vacuum in the vacuum area 10 and the less coating powder will be conveyed. Flowing in the powder feed line 14, thus, is coating powder and feed gas as well as no or a specific amount of dosing gas. The gauges 8 and 28 are provided each with a dial 29 and 30 calibrated to show the pressure and/or pressure-flow rate per unit of time, for instance $Nm^3/h$. The inputs 32 and 34 of the pressure setting instrument 6 and adjustable pressure governor or regulator 26 are connected to the outlet section 36 of a gas feed line 38, the inlet section 40 of which is connected to the outlet 42 of an electromagnetically operated on/off valve 44 (termed a way valve in DIN specifications). The two sections 36 and 40 are interconnected through a first flow measuring instrument 46, which in the illustrated embodiment is a vertically arranged floating body flow meter. It consists of an essentially vertically arranged measuring tube 48 and, arranged in it, a floating body 50 which by the gas that flows vertically upward from the inlet section 40 and through the body to the outlet section 36 is kept hovering at a certain level, depending on the strength of the gas flow. This means that the height position of the floating body 50 is a measure for the amount of gas flowing through the measuring tube 48 per unit of time. By the height position of the floating body 50 relative to a dial or marking 52 on the measuring tube 48, the operator can recognize whether the amount of gas supplied per unit of time has the desired value. This gas amount is the overall quantity composed of feed air and dosing air which flows through the injector 2 to the spray device 16. As the operator sets the pressure setting instrument 6 for feed air and/or the adjustable pressure governor or regulator 26 for dosing air to different pressure values displayed by the gauges 8 and 28, it is easy for the operator to observe, by observation of the height position of the floating body 50, that the overall air quantity of feed air and dosing air will remain at the desired value or will be adjusted to a new value.

With the invention, also a less qualified operator can in a simple way effect an optimum adjustment of the pressures and flow quantities, by observation of the gauges 8 and 28 and observation of the floating body 50 relative to the dial or marking 52.

The inlet side 54 of the valve 44 is connected through a third adjustable pressure governor or regulator 56 to a pressure gas supply, preferably a compressed air supply 58. Branching off from the connecting line 60 between the adjustable third pressure governor or regulator 56 and the valve 54 is a fluid line 62 which contains an adjustable fourth pressure governor or regulator 64 and is connected with its downstream end 56 to the powder container 12 in order to keep coating powder in it in customary fashion in a fluidized condition.

Connected to the outlet 42 of the valve 44 is also a supplemental gas line 70 for feeding supplemental gas, separate from the coating powder, to the spray device 16, which line feeds supplemental gas to the spray device 16 for cleaning the electrodes 22. The cleaning of the electrodes through supplemental gas is known from the German patent documents 36 08 415 and 36 08 426. Additionally, the supplemental gas can be used in the spray device 16 for generation of a gas flow that deflects the powder flow, such as known from the German patent document 36 08 426.

Moreover, the supplemental gas may also be used to keep coating powder from the outside surfaces of the spray device 16, such as known from the German patent disclosure 25 09 851. Contained in the supply gas line 70 is an adjustable fifth pressure governor or regulator 72 and a second flow measuring instrument 74 which may be fashioned in the same way as the first flow measuring instrument 46, with supplemental air flowing upwardly through it and, depending on flow strength, keeping a floating body 50 contained in the measuring tube 48 at a specific height position relative to a dial or marking 52. Thus, the measuring tubes 48 of the two flow measuring instruments 46 and 74 need to be transparent at least on one side so that the floating body 50 will be visible from outside. The measuring tubes 48 consist preferably overall of a transparent plastic material. Furthermore, as can be seen from the drawing, the measuring tubes preferably have an inside diameter which in the upward flow direction increases slightly in the fashion of a truncated cone.

Instead of the adjustable pressure governors or regulators 6, 26, 56, 64 and 72, adjustable flow throttles or cocks may be used as well.

The electrostatic coating device according to the invention can be manually adjusted by an operator. However, the invention also makes it possible to automatically control the adjustable pressure governors or regulators 6, 26 and 72 by a microcomputer, in contingence on set values and in contingence on measured values of the two flow measuring instruments 46 and 74.

I claim:

1. Electrostatic powder coating device, comprising a powder container (12) and a spray device (16): an injector (2) for pneumatic feeding of coating powder from the powder container to the spray device (16);

a feed gas line (4) connected to the injector (2) and provided with an adjustable first pressure setting instrument (6);

a dosing gas line (24) connected to the injector (2) and provided with an adjustable second pressure setting instrument (26);

a gas feed line (38) for feeding gas to the two pressure setting instruments (6, 26), wherein the gas feed line (38) is provided with a first flow measuring instrument (46) which provides a display (50, 52) which is contingent on the entire gas flow quantity comprising feed gas of the feed gas line (4) plus dosing gas of the dosing gas line (24) which flows per unit of time, together with the coating powder, from the injector (2) to the spray device (16).

2. Powder coating device according to claim 1, wherein a supplemental gas line (70) is provided through which supplemental air is fed to the spray device (16), separately from the coating powder, and wherein in the supplemental gas line (70) there are contained a third pressure setting instrument (72) and a second flow measuring instrument (74).

3. Powder coating device according to claim 2 wherein a second flow measuring instrument (74) is provided in the supplemental gas line (70), and wherein at least one of the two flow measuring instruments (46, 74) is a floating body flow measuring instrument with a floating body (50) hovering in the gas flow and the position of which, contingent on the flow strength, provides a measure for the gas amount flowing through per unit of time.

4. Powder coating device according to claim 3, wherein at least one of the pressure setting instruments (6, 26, 72) that are adjustable with regard to their outlet pressure is an adjustable pressure governor or regulator.

5. Powder coating device according to claim 2, wherein at least one of the two flow measuring instruments (46, 74) is a floating body flow measuring instrument with a floating body (50) hovering in the gas flow and the position of which, contingent on the flow strength, provides a measure for the gas amount flowing through per unit of time.

6. Powder coating device according to claim 2, wherein at least one of the pressure setting instruments (6, 26, 72) that are adjustable with regard to their outlet pressure is an adjustable pressure governor or regulator.

7. Powder coating device according to claim 1 wherein at least one of the pressure setting instruments (6, 26, 72) that are adjustable with regard to their outlet pressure is an adjustable pressure governor or regulator.

8. Powder coating device according to claim 1, wherein a supplemental gas line (70) is provided through which supplemental air is fed to the spray device (16), separately from the coating powder, and that in the supplemental gas line (70) there are contained a third pressure setting instrument (72) and a second flow measuring instrument (74).

9. Powder coating device according to claim 8, wherein at least one of the two flow measuring instruments (46, 47) is a floating body flow measuring instrument with a floating body (50) hovering in the gas flow and the position of which, contingent on the flow strength, provides a measure for the gas amount flowing through per unit of time.

10. Powder coating device according to claim 1, wherein at least one of the pressure setting instruments (6, 26, 72) that are adjustable with regard to their outlet pressure is an adjustable pressure governor or regulator.

* * * * *